United States Patent [19]

Folkins et al.

[11] Patent Number: 4,922,298

[45] Date of Patent: May 1, 1990

[54] AUTOMATIC COLOR SEPARATION SYSTEM

[75] Inventors: Jeffrey J. Folkins, Rochester, N.Y.; Robert N. Goren, Palasides, Calif.; James D. Rees, Pittsford, N.Y.

[73] Assignee: Xerox Corporation, Stamford, Conn.

[21] Appl. No.: 202,346

[22] Filed: Jun. 6, 1988

[51] Int. Cl.[5] ..... G03G 15/00

[52] U.S. Cl. ..... 355/218; 355/328

[58] Field of Search ..... 355/14 R, 4, 7; 346/157

[56] References Cited

U.S. PATENT DOCUMENTS

| | | | |
|---|---|---|---|
| 4,368,484 | 1/1983 | Stemme et al. | 358/41 |
| 4,642,679 | 2/1987 | Nagano | 358/75 |
| 4,777,510 | 10/1988 | Russel | 355/7 |
| 4,791,450 | 12/1988 | Mosehauer | 355/7 X |
| 4,794,421 | 12/1988 | Stoudt et al. | 355/7 X |

FOREIGN PATENT DOCUMENTS

| | | |
|---|---|---|
| 62-161260 | 7/1987 | Japan . |
| 2066610 | 7/1981 | United Kingdom . |

OTHER PUBLICATIONS

Xerox Disclosure Journal, vol. 11, No. 5, Oct. 1986, p. 253. "Highlight Color Creation Concept", by James D. Rees.

*Primary Examiner*—R. L. Moses

[57] ABSTRACT

A printer having a color copy capability is enabled by scanning an original document having at least two discrete colored areas onto a color-filtered photosensor array simultaneously with formation of an electrostatic image of the original on a photoconductor member. The array generates output signals corresponding to detected color areas of the original document. These signals are sent to the printer software which determines the detected color image coordinates of each portion of the output copy. Output copies are then made, using multiple imaging erase and development passes.

4 Claims, 3 Drawing Sheets

AUTOMATIC COLOR SEPARATION SYSTEM

BACKGROUND AND INFORMATION DISCLOSURE STATEMENT

This invention relates generally to an electrophotographic printing machine, and more particularly concerns a color discrimination system for automatically sensing the position of colored or encoded portions on an original document being copied, and for controlling erase and development means to produce an output color copy.

Hereinbefore, multicolor copying was achieved by using a multicolor electrophotographic printing machine. In the process of electrophotographic printing, a photoconductive surface is charged to a substantially uniform potential. The photoconductive surface is image-wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical black and white electrophotographic printing machine. With the advent of multicolor electrophotographic printing, the process is repeated for three or four cycles with the charged photoconductive surface being exposed to a filtered light image. The resultant electrostatic latent image is then developed with toner particles corresponding in color to the subtractive primary of the filtered light image. For example, when a red filter is employed, the electrostatic latent image is developed with cyan toner particles. The cyan toner powder image is then transferred to the copy sheet. The foregoing process is repeated for a green filtered light image which is developed with magenta toner particles and a blue filtered light image which is developed with yellow toner particles. Each differently colored toner powdered image is sequentially transferred to the copy sheet in superimposed registration with the powder image previously transferred thereto. In this way, three toner powder images are transferred sequentially to the copy sheet. After the tone powder images have been transferred to the copy sheet, they are permanently fused thereto. Thus, color electrophotographic machines previously employed require three passes to produce a multicolor copy. A typical electrophotographic printing machine employing the foregoing process is manufactured by the Xerox Corporation under the model name Xerox 1005.

These prior art machines are referred to as full process color machines and are capable of copying full color originals. The machines are relatively costly and operate at reduced speeds, relative to black and white copiers.

There exists significant applications wherein original documents to be copied have portions of the text which are of a distinctive color designed to distinguish over the remainder of the information on the document. For example, an original document may have one portion wherein the indicia is red while the remainder is monochrome. The red portion is often referred to as the "highlighted" portion of the document. While the aforementioned multicolor copying machines can produce a faithful color copy of such a color original, it would be desirable to accomplish the same end by a means less expensive and faster in operation.

Also known in the prior art are copiers capable of image editing and so called "push button color". Typical of such copiers is the Canon NP-3525. A key pad on the machine is used to select the coordinates of the region of the copy to be reproduced as a highlight color. A platen, upon which an original document is positioned, has a coordinate grid thereon. This enables the operator to select the coordinates of the copy to be reproduced in a highlight color. These coordinates are keyed into the control system of the printing machine by the operator selecting the appropriate keys of the key pad. The control system actuates selected lamps of a light source at the appropriate time in the cycle to erase the portion of the electrostatic latent image corresponding to the region of the copy to be reproduced in a highlight color. The remaining portion of the electrostatic latent image is developed with black toner. On a second pass image scan, the selectable erase lamps discharge the black portion of the electrostatic image and the remaining portion is developed by a second highlight color developer. With this type of system, it is possible to copy an original document having one or more desirable colored portions. However, this requires an operator input. For example, if an original document has a discrete area with a red text thereon, and it is desired to produce an output copy faithful to the original, the operator must select the coordination of the original, enter them into the control system and select the color, in this case red.

It would be a desirable feature for a printing machine to have the capability of automatically identifying an original which has both black and color areas and of producing output copies reproducing these areas. It would also be desirable to create output copies of original documents wherein the contents and/or color of the original document is altered from its original state. Deletion of certain portions of an original document might be one example while a highlighting of certain portions of a document in a highlight color different than that identified in the original would be another. This second feature may be referred to as an "editing" function. Both features are realized, according to the present invention, by scanning the document to be copied, either prior to the initiation of a copy mode (e.g. in a prescan mode) or, preferably, at the same time the original document is being exposed. The light image is projected through a lens onto a low resolution, solid state photosensor array which incorporates appropriate color filters. The array can be adapted to either detect any color other than black or can recognize one of a plurality of colors. The array generates electrical output signals representing the sensed original image. The array output signals are digitized within a control system. An appropriate algorithm is used to establish the position (coordinates) of the colored portions of the original and to temporarily store the signals representing these coordinates. The control system, during appropriate times of the operation cycle, generates signals causing erase of portions of a latent image formed on the photoconductor and/or causes the remaining image to be developed with a developer material of the appropriate color. The final output copies are made using multiple imaging and development passes.

The following U.S. patents have been identified as disclosing relevant subject matter:

U.S. Pat. No. 4,368,484 to Stemme et al discloses a device for color scanning with a CCD array to reproduce photographic positives or negatives as video images. The device also includes a shift register unit and a clock pulse generator. Individual output channels for each of the three primary colors are connected to a gamma-balancing stage to effect contrast corrections.

U.S. Pat. No. 4,642,679 to Nagano discloses a color image reading apparatus in which a CCD is provided for detecting images under green, red, and blue light. Voltage produced from the CCD is applied to a sample/hold circuit which then produces a voltage $V_o$. This second voltage is applied to a subtraction circuit comprising a register, buffer, D/A converter multiplier and three memories.

Japanese Laid Open (Kokai) Publication 62-161260 discloses an image-forming system which uses an optical system including photoelectric devices to identify color areas manually highlighted on an original.

Xerox Disclosure Journal Vol. 11, Number 5, October 1986, p. 253 discloses use of a double filter over a CCD array which, in conjunction with an electric circuit, identifies areas of an original highlighted with a yellow pen.

U.K. publication 6B 2,066,610 employs a CCD array to identify areas of an original which have been marked with a particular color.

In accordance with one aspect of the present invention, there is provided a color printing machine for printing color output copies of a color document, the machine including:

a xerographic imaging system comprising a photoconductor member, means for charging the surface of said member, scanning optical means for forming successive latent electrostatic images of said original on the surface of said member, means for erasing selected portions of said latent image, means for developing the latent image in at least two colors, means for transferring said developed image to a copy sheet and means for fusing said transferred image, said imaging system further comprising:

sensing means for discriminating between colored areas of said original document and for generating electrical signals representative of said colored areas, control means adapted to digitize and store said sensing means output signals, said control means further adapted to operate said erase means so as to erase areas of at least a first and second latent image, and to operate said developer means so as to develop the remaining latent image, following said erase operation, with a color toner appropriate to the color of the non-erased image.

IN THE DRAWINGS

DESCRIPTION OF THE INVENTION

While the present invention will hereinafter be described in conjunction with an embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
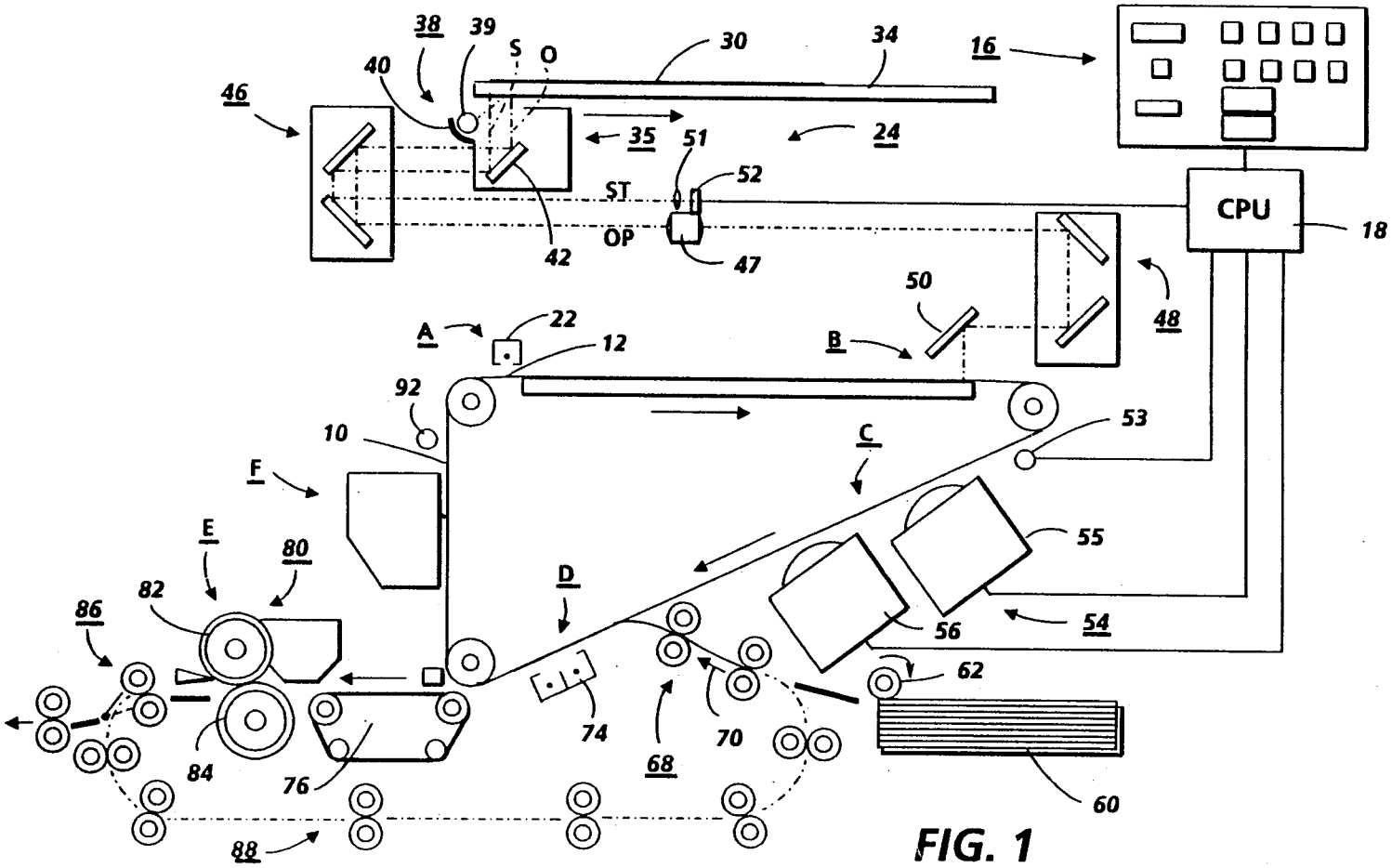
FIG. 1 is a schematic elevational view showing an electrophotographic printing machine incorporating the automatic highlight color separation system of the present invention.

For a general understanding of the features of the present invention, reference is made to the drawings. In the drawings, like reference numerals have been used throughout to designate identical elements. FIG. 1 schematically depicts the various components of an electrophotographic printing machine incorporating the features of the present invention therein. Inasmuch as the art of electrophotographic printing is well known, the various processing stations employed in the FIG. 1 machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Belt 10 moves in the indicated direction, advancing sequentially through the various xerographic process stations. The belt is entrained about a drive roller 14 and two tension rollers.

In operation, the operator may select the number of copies being reproduced as well as of adjusting any of the parameters within the various processing stations. This is achieved by keying in the required adjustment and number of copies at the control panel, indicated generally by the reference numeral 16. Control panel 16 is electrically coupled to a centralized processing unit, indicated generally by the reference numeral 18. Preferably, centralized processing unit (CPU) 18 is a microprocessor made by Intel Corporation under the Model No. 8086. CPU 18 is electrically connected to the various processing stations within the electrophotographic printing machine so as to control their operation.

With continued reference to FIG. 1, a portion of belt 10 passes through charging station A where a corona generating device, indicated generally by the reference numeral 22, charges photoconductive surface 12 to a relative high, substantially uniform, negative potential.

Next, the charged portion of photoconductive surface 12 is advanced through an imaging station B. The imaging station includes an exposure system, indicated generally by the reference numeral 24. An original document 30 is positioned face down on a transparent platen 34. Optics assembly 35 contains the optical components which incrementally scan-illuminate the document from left to right and project a reflected image onto surface 12 of belt 10, forming a latent image of the document thereon. Shown schematically, these optical components comprise an illumination lamp assembly 38, comprising an elongated tungsten illumination lamp 39 and associated elliptical reflector 40. Assembly 38 and full rate scan mirror 42 are mounted on a scan carriage (not shown) adapted to travel along a path parallel to and beneath the platen. Lamp 39, in conjunction with reflector 40, illuminates an incremental line portion of document 30. The reflected image is reflected by scan mirror 42 to corner mirror assembly 46 which is adapted to move at ½ the rate of carriage mirror 42. The document image is projected along optical path OP through lens 47 and reflected by a second corner mirror assembly 48 and by belt mirror 50, onto surface 12 to form thereon an electrostatic latent image corresponding to the information areas contained within original document 30. The light image is also reflected along a second optical path ST following a path reflected from mirror assembly 46 through reduction lens 51 onto a solid state photosensor array 52. Array 52, in a preferred embodiment, comprises a 1024 element CCD array of sufficient width to sense the entire image projected through lens 51. The array is constructed to have an inherent filtering function; e.g. red, blue, green with adjacent elements covered with a specific filter. A suitable array is a Toshiba TD11 OBC.

Continuing with the system description, the region between successive electrostatic latent images and the lateral marginal regions of the electrostatic latent image are discharged by erase bar 53 extending across surface 12 in a direction substantially perpendicular to the direct of belt rotation. Erase bar 53, which can comprise a plurality of light emitting diodes, also erased areas corresponding to areas of the original document electrostatic latent image which are not to be developed during that pass. The erase function is performed in response to appropriate commands from the CPU 18, as will be discussed below.

At the development station C, a magnetic brush development system, indicated generally by the reference numeral 54, includes, in the embodiment shown, a first developer unit, indicated generally by the reference numeral 55 and a second developer unit, indicated generally by the reference numeral 56. Developer unit 55 is adapted to develop the electrostatic latent image with black toner particles while developer unit 56 is adapted to develop the electrostatic latent image with toner particles of a color other than black, e.g. red. Each developer unit is cammed into and out of their respective development zones in response to signals from CPU 18. The output from the voltage CPU 18 is electrically coupled to the developers to regulate its operation, including application of the bias potential.

After development, belt 10 advances the toner powder image to the transfer station D. At the transfer station, a sheet of support material is moved into contact with the powder image. The sheet of support material is advanced to transfer station D by a sheet feeding apparatus, indicated generally by the reference numeral 60. Preferably, sheet feeding apparatus 50 includes a feed roll 62 contacting the uppermost sheet of a stack of sheets 64. Feed roll 62 rotates in the direction of arrow 66 so as to advance the uppermost sheet into the nip defined by forwarding rollers 68. Forwarding rollers 68 rotate in the direction of arrow 70 to transport the sheet into contact with photoconductive surface 12 of belt 10 so that the toner powder image developed thereon contacts the advancing sheet at the transfer station.

Preferably, the transfer station includes a corona generating device 74 which sprays ions onto the backside of the sheet. This attracts the toner powder image from photoconductive surface 12 to the sheet. After transfer, the sheet continues to move on conveyor 76, in the direction of the arrow, to fusing station E.

Fusing station E includes a fuser assembly, indicated generally by the reference numeral 80 which permanently affixes the transferred toner powder image to the sheet. Preferably, fuser assembly 80 includes a heated fuser roller 82 and a back-up roller 84. The sheet passes between fuser roller 82 and back-up roller 84 with the powder image contacting fuser roller 82. In this manner, the powder image is permanently affixed to the sheet. After fusing, forwarding rollers 86 either advance the sheet to a catch tray (not shown) for subsequent removal from the printing machine by the operator of, if a color highlight copy is being produced, the sheet is recirculated to the transfer station along copy return path 88 so that, following a second exposure and erase step, the next toner powder image may be transferred thereto. Thereafter, the sheet passes through the fusing station to permanently affix this powder image thereto and the resultant highlight color copy advances to the catch tray.

After the powder image is transferred from photoconductive surface 12 to the copy sheet, belt 10 rotates the photoconductive surface to cleaning station E. At the cleaning station a brush cleaning system removes the residual particles adhering to photoconductive surface 12. A discharge lamp 92 is activated prior to charge.

Figure 2:
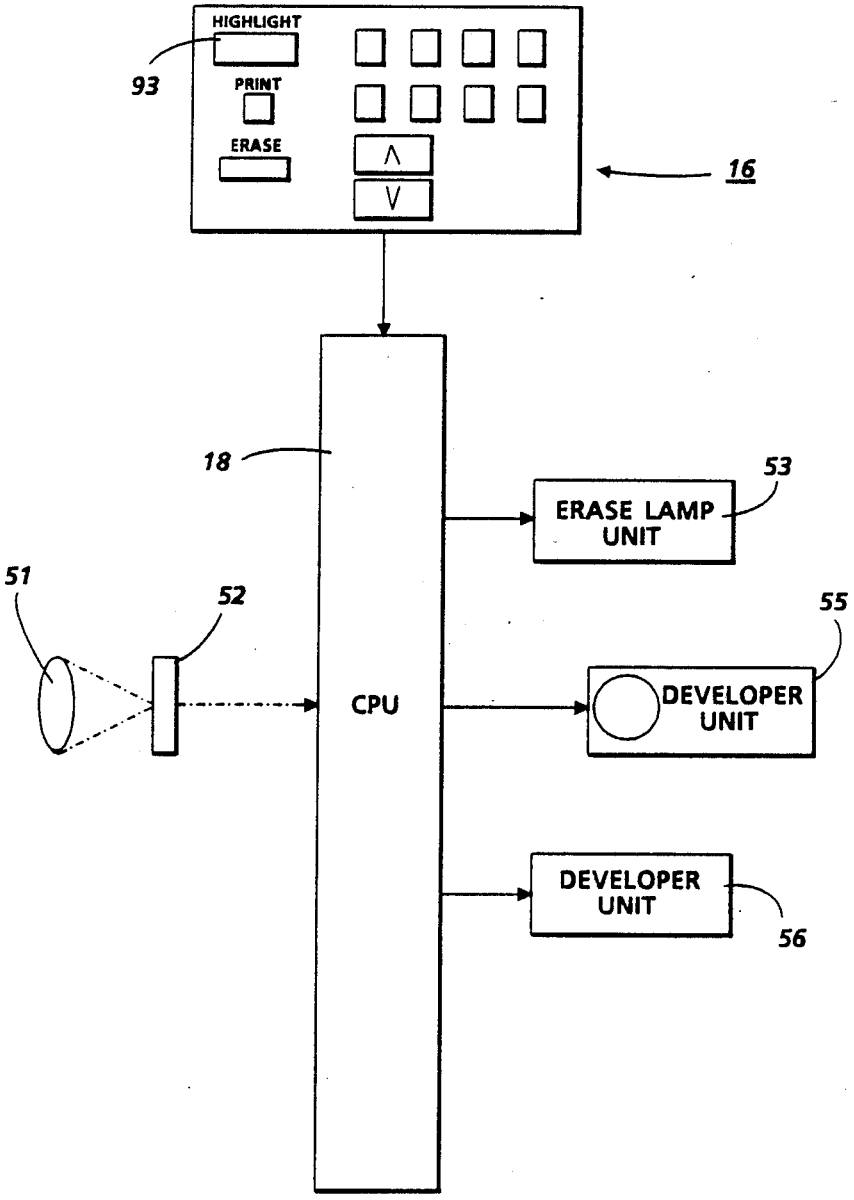
FIG. 2 is a block diagram of the circuitry for controlling the automatic highlight separation system.

It is believed that the foregoing description is sufficient for purposes of the present invention to illustrate the operation of an electrophotographic printing machine incorporating the features of the present invention therein. Referring now to FIG. 2, the details of the control scheme associated with the automatic color separation capability will be discussed.

As mentioned above, a light image of the document is projected along optical path ST by lens 51 onto array 52. The lens 51 forms an image of the portion of the document whose wavelengths is transmitted by the associated filter. Each photosensor then generates an electrical video image corresponding to that colored portion of the original document. The photosensor array outputs are electrically coupled to CPU 18.

Assuming a document with a highlighted color area, for example red, is to be copied, an operator depresses an appropriate *highlight* key 93 of control panel 16 (FIG. 2). Depression of the key enables the color separation circuit and the scanning cycle and a light image is sensed at array 52. Analog signals are generated by the the array representing the position and color of the sensed areas. These signals are digitized within the CPU. An algorithm is used to identify the position and color of the sensed color areas and to generate representative signals which are temporarily stored. Simultaneously with the implementation of the highlight sensing function, the document image is being projected along optical path OP and a latent image formed at surface 12. Erase bar 53 is selectively energized by CPU 18 at an appropriate time of the cycle and in a pattern causing the erase of all areas on the latent image passing thereunder which correspond to the red portions of the original document. Developer unit 55 is subsequently activated in response to CPU 18 signals and develops the non-erased latent image with conventional black toner. The first image is transferred at station D, fused at station E and then returned along copy return path 88, as is known in the art, to the copy feed station. The belt surface is cleaned and recharged at charging station A and a second exposure of the document is accomplished to form a second latent image on the drum surface. The erase array 53 is now selectively activated in a pattern causing the black areas to be erased. The remaining latent image is developed with the red toner contained in developer 56, which is activated by CPU 18. The red developed image is subsequently transferred to the copy sheet which advances to the transfer zone in a registration sequence controlled by the CPU. The red image is fused, resulting in a two-color output copy. From the above description it will be appreciated that the purpose of the sensing array and related control activity is not to actually sense informational-type data on the original but rather to identify the position of a particular colored area on the original and to derive, electronically, coordinates for this area which can be represented by electrical output signals. These output signals can then be used, with suitable timing and registration circuits, to enable the erase means and development means so as to form the output copy with a colored image at the same location as on the original.

Figure 3:
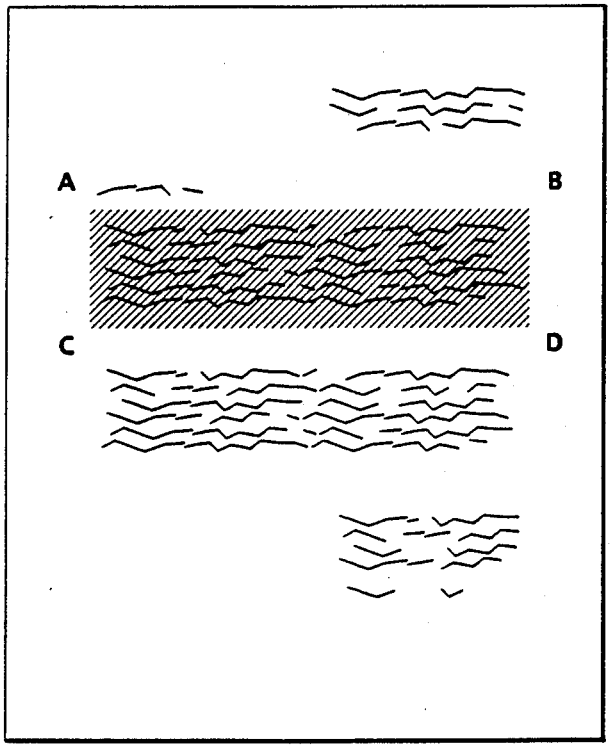
FIG. 3 represents an original document showing an encoded area.

The above description is related to a faithful color reproduction (process color) mode. According to a second aspect of the present invention, the copying operation may also accommodate an editing function. An original document with information found therein is shown in FIG. 3. For descriptive purposes, it is assumed that it is desired to reproduce this document with the information within the rectangle bounded by area ABCD deleted. The operator first encodes the specified area by marking the entire area with a pen color which is outside the photoconductivity range of the photoconductor. For purposes of discussion, it is assumed belt 10 is a selenium alloy photoconductor, a light blue copy pen can thus be used. (Instead of marking directly onto the original document, a transparent overlay may be used with the marking on the overlay.) The encoded original is then placed on the platen. The operator will then, referring to FIG. 2, depress the ERASE button followed by the PRINT button.

A light image of the document is projected along optical path ST by lens 51 onto array 52. The lens forms an image of the array portion of the document which has been encoded (ABCD) whose wavelength is transmitted by the associated filter. Each photosensor then generates an electrical video image corresponding to the encoded portion of the original document. The array output is electrically coupled to CPU 18.

Analog signals are generated by the the array representing the position of the encoded area. These signals are digitized within the CPU. An algorithm is used to identify the position of the encoded area and to generate representative signals which are temporarily stored. Simultaneously with the implementation of the sensing function, the document image is being projected along optical path OP and a latent image formed at surface 12. Erase bar 53 is selectively energized by CPU 18 at an appropriate time of the cycle and in a pattern causing the erase of all areas on the latent image passing thereunder which correspond to the sensed, encoded portions of the original document. Developer unit 55 is subsequently activated in response to CPU 18 signals and develops the non-erased latent image with conventional black toner. The image is transferred at station D, fused at station E and exits the system to a catch tray.

The above description covered the erasure mode of the present invention which entailed only a single cycle of system operation. The invention can also be practiced in a highlight color mode wherein the encoded portion of the document is first erased, as described above, and is then exposed and developed during a second machine cycle, in a highlight color. For this mode, and assuming area ABCD of FIG. 3 is to be printed in a highlighted color of red, the operator would depress the HIGHLIGHT switch on the control panel (FIG. 2) and subsequently depress the PRINT switch. During the first pass, area ABCD is erased as described above. The first image is transferred at station D, fused at station E to the copy feed station. The belt surface is cleaned and recharged at charging station A and a second exposure of the document is accomplished to form a second talent image on the drum surface. The erase array 53 is now selectively activated in a pattern causing the non-encoded areas outside ABCD to be erased. The remaining latent image (areas ABCD) is developed with the red toner contained in developer 56, which is activated by CPU 18. The red developed image is subsequently transferred to the copy sheet which advances to the transfer zone in a registration sequence controlled by the CPU. The red image is fused, resulting in a two-color output copy.

The above examples can be considered detection modes in which the CCD is required only to detect a color other than black. The system can also be operated in a recognition mode wherein one of a plurality of colored portions of an original document can be separated and reproduced, the non-selected colored portions of the original being reproduced with black indicia. For this application the control system software would be set to detect any color other than the selected color, as black indicia.

While the above system utilized a single array with inherent color filtering capability, other systems may contemplate using multiple CCD arrays with color filters over each array or using a mechanically moveable filter over a single array and making multiple scanning passes.

Further changes and modifications may be made consistent with the scope of the invention. As one example, while the color highlight sensing is preferably enabled simultaneously with formation of the latent image, the color separation may also be accomplished in a prescan mode. For example, a separate input station could include a raster input scanner (RIS) which would scan the document as it is transported across the platen by a continuous velocity transport device. The RIS system would incorporate the edge detection and timing circuits for registration in the subsequent copying operation. The color separation area indications are stored and applied during the subsequent scan operation.

What is claimed is:

1. A color printing machine for printing faithful color output copies of an original document having at least two discrete colored areas, said machine including:

a xerographic imaging system comprising a photoconductor member, means for charging the surface of said member, optical means for forming successive latent electrostatic images of said original on the surface of said member, means for erasing selected portions of said latent image, means for developing the latent image in at least two colors, means for transferring said developed image to a copy sheet and means for fusing said transferred image, said imaging system further comprising:

sensing means enabled essentially simultaneously with the forming of said electrostatic image for discriminating between colored areas of said original document and areas outside said colored areas and for generating electrical signals representative of said colored and noncolored areas, control means adapted to operate upon said sensing means output signals so as to generate and store electronic signal representing coordinates of said colored areas, said control means further adapted to operate said erase means so as to erase areas, during at least a first and second pass, of at least a first and second latent image, and to operate said developer means so as to develop the remaining latent image, following each said erase operation, with a desired color or black toner.

2. The printing machine of claim 1, wherein said sensing means is adapted to recognize any color other than black.

3. The printing machine of claim 1, wherein said sensing means is adapted to recognize one specific color only.

4. The printing machine of claim 1, wherein said optical means is a raster input scanner.

* * * * *